US006762353B2

(12) United States Patent
Okumura

(10) Patent No.: US 6,762,353 B2
(45) Date of Patent: Jul. 13, 2004

(54) PERCUSSION INSTRUMENT HEAD

(75) Inventor: Yukimasa Okumura, Hamamatsu (JP)

(73) Assignee: Yamaha Corporation, Shizuoka-ken (JP)

( * ) Notice: Subject to any disclaimer, the term of this patent is extended or adjusted under 35 U.S.C. 154(b) by 0 days.

(21) Appl. No.: 10/345,925

(22) Filed: Jan. 17, 2003

(65) Prior Publication Data

US 2003/0136245 A1 Jul. 24, 2003

(30) Foreign Application Priority Data

Jan. 18, 2002 (JP) ..... P2002-010076

(51) Int. Cl.[7] ..... G10D 13/02
(52) U.S. Cl. ..... 84/411 R; 84/414
(58) Field of Search ..... 84/411 R, 414, 84/416, 417, 421

(56) References Cited

U.S. PATENT DOCUMENTS 3,635,119 A * 1/1972 Thompson ..... 84/411 R
3,664,911 A * 5/1972 Takabayashi ..... 442/224
5,585,581 A * 12/1996 Rogers ..... 84/414

* cited by examiner

*Primary Examiner*—Kimberly Lockett
(74) *Attorney, Agent, or Firm*—Dickstein, Shapiro, Morin & Oshinsky, LLP.

(57) ABSTRACT

A percussion instrument head is composed of a synthetic resin film (e.g., a PET film) having a prescribed thickness, which is subjected to chemical etching using a prescribed solution (e.g., an alkali solution), thus processing at least one surface thereof to be rough. Irregularities are formed in substantially uniform sizes and dimensions on the rough surface of the film, wherein hydrolysis processing advances firstly on the surface of the film, which are gradually dissolved or decomposed. Thus, it is possible to simulate the exterior appearance and flexibility of the conventional natural-leather head, and it is possible to produce sharp and articulated sounds having balanced pitches (or intervals) when playing the percussion instrument head composed of the synthetic resin film, which can simulate the property of sound of the conventional natural-leather head. After completion of chemical etching, the film is coated with an epoxy resin, for example.

14 Claims, 3 Drawing Sheets

PERCUSSION INSTRUMENT HEAD

BACKGROUND OF THE INVENTION

1. Field of the Invention

This invention relates to percussion instrument heads such as drumheads for snare drums, bass drums, and timpanies, which are composed of synthetic resin films.

2. Description of the Related Art

In general, percussion instruments such as snare drums are made of hollow cylinders whose openings are covered with stretched skins, namely, percussion instrument heads such as drumheads. In particular, percussion instrument heads composed of synthetic resin films can be manufactured at relatively low cost and are therefore advantageous in mass production in comparison with percussion instrument heads composed of natural leathers. In addition, synthetic-resin heads are hardly influenced by environmental factors such as variations in temperature and humidity. Furthermore, they produce "hard" sounds when beaten with drumsticks and the like.

Generally, synthetic-resin heads are each composed to one or two plies of synthetic resin films. Heads each composed of one ply of a synthetic resin film are characterized in good responses and are capable of producing sound components of higher frequencies. However, they are incapable of producing "sharp" sounds in comparison with natural-leather heads because of the relatively long duration of sound in the tone pitch thereof. In particular, in the case of marching drums that are required to produce articulated sounds, overtones contained in sounds, which are produced by actually beating drums with drumsticks, for example, may be greatly extended in the duration thereof. In order to cope with such a disadvantage, users are required to adjust the duration of overtones by attaching mutes and the like to percussion instruments. Similar things can be said of other types of heads for use in timpani (or kettledrums) and the like, wherein overtones are extended very much in duration, which may cause unbalanced pitches (or intervals) in sound.

Heads each composed of two plies of synthetic resin films can be classified into three types as follows:

(1) Two synthetic resins are merely placed one on the other.

(2) Outer peripheries of synthetic resin films are adhered to each other by adhesive, while center portions are brought into close contact with each other.

(3) Overall areas of synthetic films are entirely adhered to each other by adhesive.

In addition, it is possible to paint patterns on surfaces of films, thus realizing variations in sound qualities in percussion instruments.

The aforementioned two-ply heads described in (1) and (2) may be capable of producing relatively sharp and articulated sounds; however, they have a problem in responses of sound components of higher frequencies. The two-ply heads described in (3) cannot produce clear differences in comparison with the conventional one-ply heads because of "intense" adhesion of the adhesive that is applied to synthetic resin films, wherein it is very difficult to cause positional deviations between synthetic resin films due to vibrations, which initially occur on the front-side synthetic resin film when beaten and are transmitted to the backside synthetic resin film. That is, the two-ply heads described in (3) are incapable of producing sharp sounds because of the extended duration of sound components of higher frequencies, similarly to the conventional one-ply heads.

In order to cope with the aforementioned disadvantages, Japanese Unexamined Patent Publication No. Hei 10-301560 discloses a musical instrument head and a manufacturing method therefore, wherein the musical instrument head is designed to produce sharp and articulated sounds, thus actualizing balanced pitches (or intervals) in sound. Herein, the surface of a synthetic resin sheet is polished with an emery cloth to produce roughening or irregularities thereon; then, the surface and backside of the synthetic resin sheet are coated with epoxy resins and the like, thus forming substantially planar and uniform contact surfaces. This musical instrument head has good resonating effects and can produce overtones or higher harmonic sounds having sufficiently large magnitudes in comparison with the conventional heads. In addition, this musical instrument head can be appropriately designed to simulate the exterior appearance of a natural leather because of formation of shades on the surface of the synthetic resin sheet.

According to Japanese Unexamined Patent Publication No. Hei 10-301560, the musical instrument head is manufactured in such a way that the surface of the synthetic resin sheet is mechanically polished with an emery cloth to be matted or rough (e.g., grainy or granular), which causes unexpected variations in sizes and depths of irregularities formed on the surface of the synthetic resin sheet. That is, it is very difficult to form "uniform" irregularities on the surface of the synthetic resin sheet. As a result, unexpected variations may occur in sound qualities of musical instrument heads, which are manufactured as described above. Thus, it is very difficult to manufacture musical instrument heads whose sound qualities are controlled and stabilized.

SUMMARY OF THE INVENTION

It is an object of the invention to provide a percussion instrument head having a rough (e.g., grainy or granular) surface on which irregularities having uniform sizes are formed by effecting chemical etching, instead of mechanical polishing, so that the percussion instrument head is capable of producing sounds of good quality.

A percussion instrument head of this invention is composed of a synthetic resin film such as a PET film having a prescribed thickness, which is subjected to chemical etching using a prescribed solution such as a caustic alkali solution, thus processing at least one surface thereof to be rough. Herein, irregularities are formed in substantially uniform sizes and dimensions on the rough surface of the film. Specifically, the solution is applied to the film in order to process a single-side surface of the film to be rough. Alternatively, the film is soaked in the solution in order to process both surfaces of the film to be rough. That is, hydrolysis processing advances firstly on surfaces of the film, which are gradually dissolved or decomposed to form irregularities, sizes and dimensions of which can be adequately controlled. After completion of chemical etching, it is possible to coat the film with an epoxy resin, for example.

Due to chemical etching in comparison with mechanical polishing, it is possible to form irregularities having substantially uniform sizes and dimensions on the surface(s) of the film for use in manufacture of the percussion instrument head, which can simulate the exterior appearance and flexibility of the conventional natural-leather head. Thus, it is possible to produce sharp and articulated sounds having balanced pitches (or intervals) when playing the percussion instrument head composed of the synthetic resin film, which can simulate the properties of the sounds of the conventional natural-leather head.

BRIEF DESCRIPTION OF THE DRAWINGS

These and other objects, aspects, and embodiments of the present invention will be described in more detail with reference to the following drawings, in which.

DESCRIPTION OF THE PREFERRED EMBODIMENTS

This invention will be described in further detail by way of examples with reference to the accompanying drawings.

Figure 1:
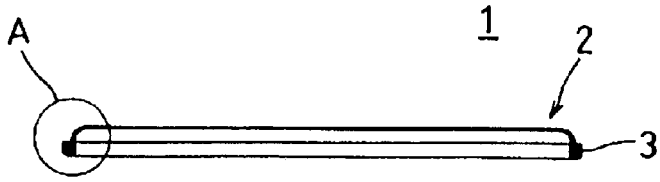
FIG. 1 is a cross sectional view showing a percussion instrument head composed of a synthetic resin film in accordance with a preferred embodiment of the invention.
Figure 2:
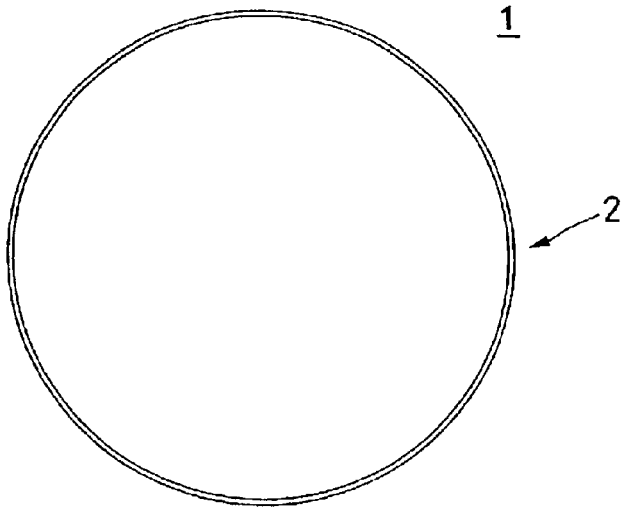
FIG. 2 is a bottom view of the percussion instrument head of FIG. 1.
Figure 3:
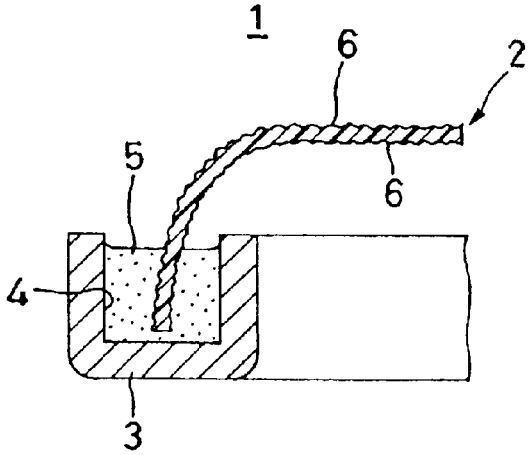
FIG. 3 is an enlarged cross sectional view of an end portion A of the percussion instrument head of FIG. 1.

FIG. 1 is a cross sectional view showing a percussion instrument head in accordance with the preferred embodiment of the invention. FIG. 2 is a bottom view of the percussion instrument head of FIG. 1; and FIG. 3 is an enlarged cross sectional view of an end portion A of the percussion instrument head of FIG. 1. That is, a percussion instrument head 1 of the present embodiment is composed of a synthetic resin film 2 having a disk-like shape, which has a prescribed size and dimensions. The outer periphery of the synthetic resin film 2 is inserted into the hollow of a ring channel 4 of a head frame 3 and is then fixed to the head frame 3 by an adhesive 5. Both the front and backside surfaces of the synthetic resin film 2 are subjected to chemical etching, so that numerous small irregularities 6 are formed in a random pattern on both surfaces of the synthetic resin film 2. Herein, all the irregularities 6 have substantially uniform size and dimensions.

The synthetic resin film 2 is made of a polyethylene terephtalate (PET) film, or the like and is formed in a prescribed thickness, which may range from 50 $\mu$m to 350 $\mu$m, for example.

When the synthetic resin film 2 is made of a PET film, chemical etching is performed using a caustic alkali solution, for example. When a PET film is soaked in the caustic alkali solution, hydrolysis processing advances firstly on surfaces of the PET film, which may be gradually decomposed to cause formation of irregularities 6. Thus, it is possible to process the PET film to have a rough surface. The aforementioned processing may be called 'loss processing', which causes loss of weight with respect to a processed subject and which is normally used as one processing method for improving the texture (or feeling) of a polyester film. By applying the aforementioned dissolving measures to the PET film, it is possible to realize loss of weight in the PET film, surfaces of which are adequately etched.

In order to perform chemical etching on a single-side surface of the film, an etching solution is applied to a designated surface of the film. In order to perform chemical etching on both surfaces of the film, the film is soaked in an etching solution. Therefore, chemical etching is advantageous in comparison with mechanical polishing because the overall surface(s) of the film can be entirely and uniformly processed easily. Thus, it is possible to reliably form matte finishes on the film, wherein irregularities 6 are formed in substantially uniform sizes and dimensions. That is, it is possible to produce a percussion instrument head using the synthetic resin film, which is chemically etched to simulate a rich flexibility of the conventional natural-leather head. In addition, the percussion instrument head of the present embodiment can realize a "soft" sound quality, which is similar to that of the natural-leather head. Furthermore, the present embodiment can realize speedy attenuation (or damping) of sound components of higher frequencies; hence, it is possible to produce sharp and articulated sounds having balanced pitches (or intervals). Hence, the present embodiment can actualize a good balance in sound with respect to attack, sustain, and decay portions.

The chemical etching for the synthetic resin film 2 can be realized based on a delicate balance with respect to alkali agent, concentration of alkali solution, and processing time, which may cause difficulties in producibility and proccessability. When the aforementioned balance collapses, loss processing greatly advances firstly in comparison with etching, which may finally cause complete decomposition or dissolution of the film. Hence, the chemical etching should be performed under strictly controlled conditions. Surfaces of the film are delicately etched, resulting in irregular continuities in roughness like interfaces. This creates preferable properties in processing films, which are very difficult to be achieved by other processing methods using emery cloths and the like. That is, it is possible to reliably form rough surfaces of films in which irregularities 6 are formed in substantially uniform sizes and dimensions. Preferably, depths of irregularities 6 may range from 1.5 $\mu$m to 3 $\mu$m, for example.

In the case of mechanical polishing using an emery cloth, the strength (or tension) of the film should be reduced when irregularities are greatly increased in sizes and depths. That is, the film may be likely to be destroyed when stretched under a prescribed tension because of concentration of stress at deep grooves thereof. In contrast, the aforementioned chemical etching can actualize "expected" formation of irregularities 6 having substantially uniform sizes and dimensions on the film; therefore, it is possible to reliably avoid occurrence of concentration of stress when the film is stretched under a prescribed tension.

In addition, it is possible to simulate the exterior appearance of the natural-leather head due to shades of irregularities 6, which are formed on the rough surface of the percussion instrument head.

Figure 4:
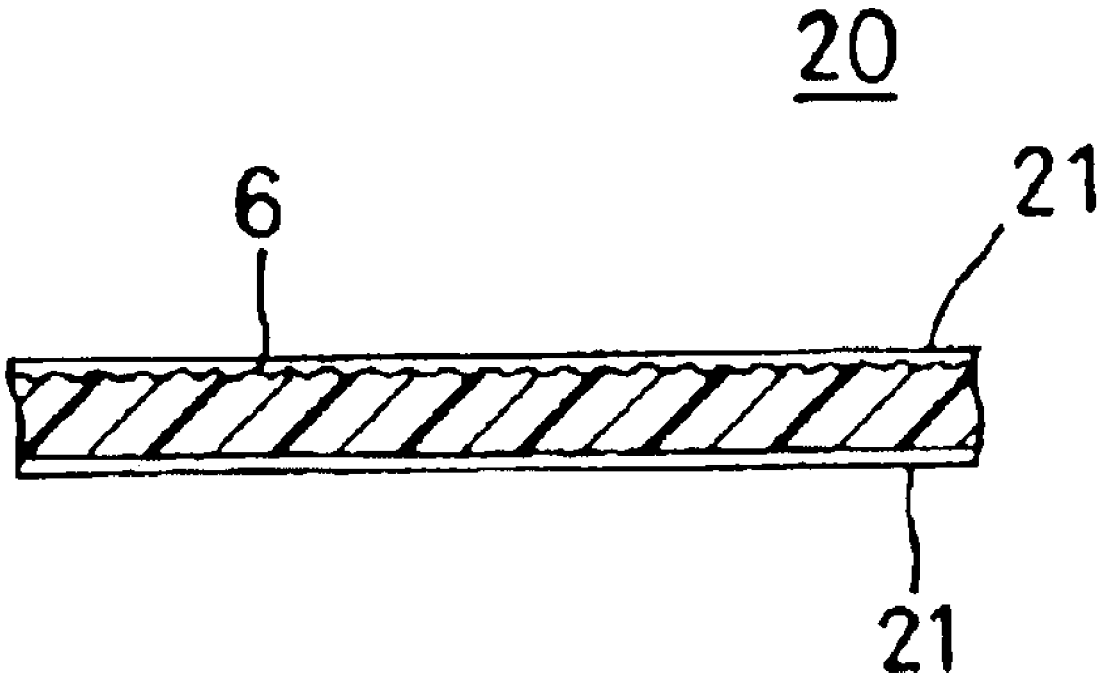
FIG. 4 is a cross sectional view showing an essential part of a percussion instrument head in accordance with a second embodiment of the invention.

FIG. 4 is a cross sectional view showing an essential part of a percussion instrument head in accordance with the second embodiment, wherein a single-side surface of a synthetic resin film 20 is only subjected to chemical etching, thus forming irregularities 6 thereon. After completion of chemical etching, both surfaces of the synthetic resin film 20 are both coated with resins 21 such as silicone resins. The aforementioned chemical etching is performed by applying a prescribed chemical agent such as caustic alkali solution to the designated surface of the synthetic resin film 20.

A percussion instrument head can be produced using the synthetic resin film 20 whose thickness is adequately determined, on which irregularities 6 having adequate sizes and dimensions are formed by chemical etching. The percussion instrument head using the synthetic resin film 20 can produce soft and articulated sounds because of adequately controlled flexibility similar to that of the aforementioned percussion instrument head 1.

In accordance with the aforementioned embodiment of the invention, various examples of percussion instrument heads using synthetic resin films are actually manufactured as follows:

There is provided a PET film whose thickness is set to 300 μm, which is soaked in a caustic alkali solution, thus performing chemical etching on a designated surface of the PET film. The film is cleaned and is then dried by hot air. This causes loss of weight with respect to the film, which is adequately processed to have a thickness of 260 μm, wherein depths of irregularities formed on the surface range from 1.5 μm to 3 μm.

In the aforementioned embodiments, chemical etching is performed on a single-side surface of a synthetic resin film or both surfaces of a synthetic resin film. Herein, chemical etching is not necessarily performed on a "front" surface of a synthetic resin film; hence, chemical etching can be performed on a "backside" of the synthetic resin film.

Figure 5:
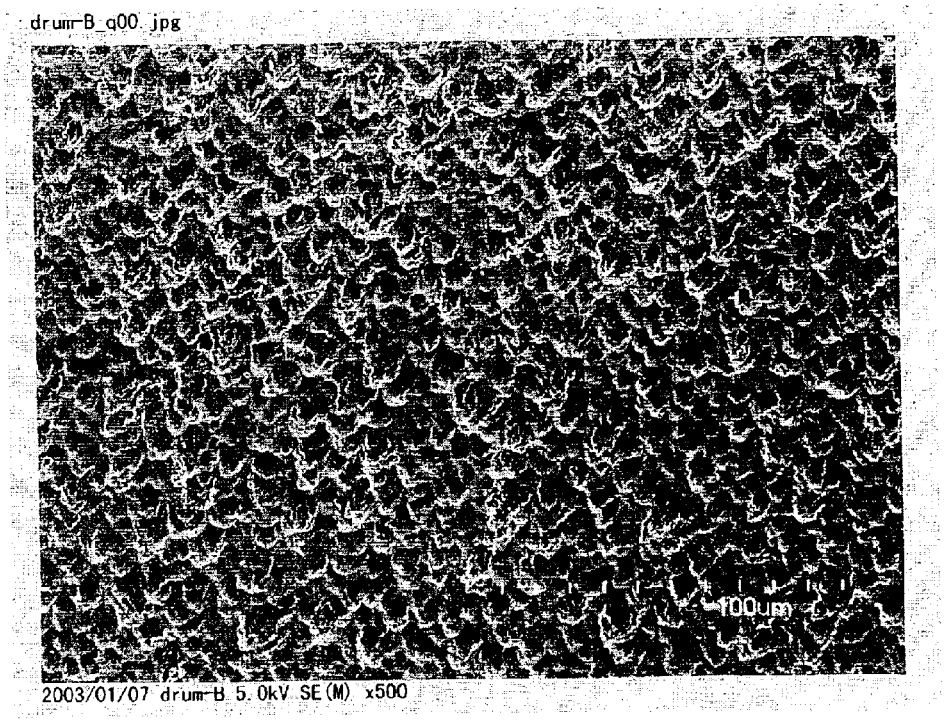
FIG. 5 is an electron micrograph showing the surface of the drumhead actually produced in accordance with the invention.

Lastly, differences between the drumhead of this invention and the conventional drumhead will be described using electron micrographs shown in FIGS. 5 and 6, which are taken at the same magnification (e.g., magnification factor '500'). FIG. 5 shows the surface of the drumhead of this invention in which small irregularities are formed uniformly and entirely on the film surface due to chemical etching. Since the surface of the film of this invention has a sufficient degree of uniformity in formation of irregularities, the film can be directly used for a drumhead having a good sound quality without being coated with a resin on the surface thereof. In addition, it may be also possible to form a uniform surface by coating the "chemically etched" film surface with a resin. Furthermore, in the case of a snare drum whose surface is required to have some degree of roughness, the chemically etched film surface can be coated with a resin including grains or particles, thus producing a drumhead having a desired roughness uniformly and entirely formed thereon.

Figure 6:
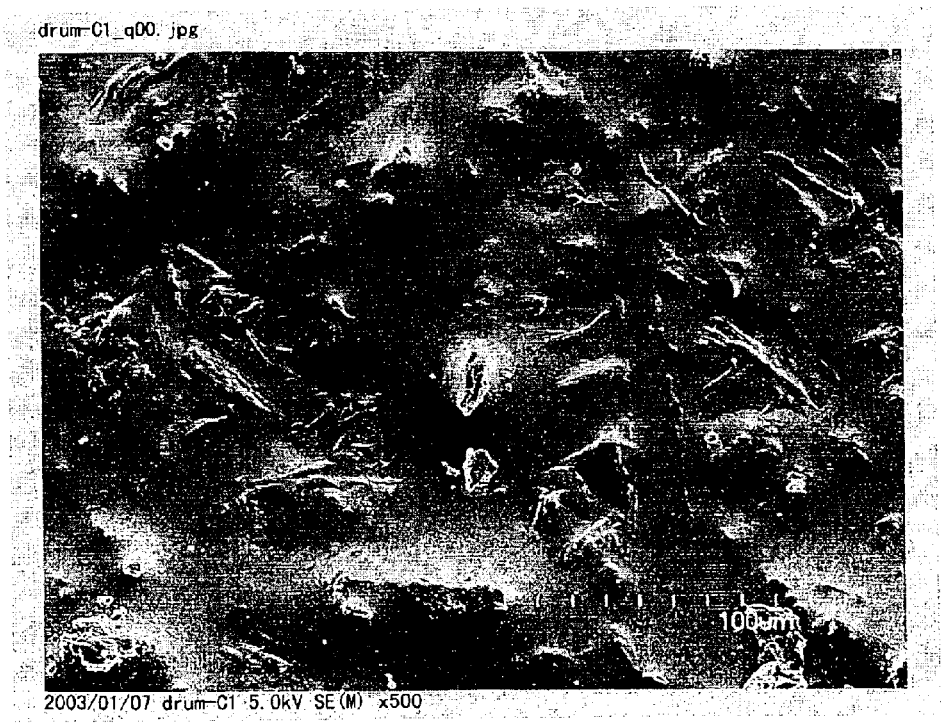
FIG. 6 is an electron micrograph showing the surface of the drumhead conventionally produced.

FIG. 6 shows a film surface that is polished using an emery tool or the like to be rough and is then coated with a resin, wherein irregularities are formed in a non-uniform manner in sizes and depths; therefore, even when the film surface is coated with a resin, the film surface is very difficult to have a sufficient degree of uniformity in formation of irregularities. Specifically, small projections may be extruded from the resin-coated surface of the film, or linear grooves may be formed on the film surface due to polishing using an emery tool or the like.

As described heretofore, this invention has a variety of technical features and effects, which will be described below.

(1) A percussion instrument head of this invention is manufactured using a synthetic resin film having a prescribed thickness, which is subjected to chemical etching with respect to at least one surface thereof. Herein, the chemically etched surface of the film is processed to be rough with numerous small irregularities, which simulates properties of a natural-leather head having a high degree of flexibility. That is, the percussion instrument head can realize softness in sound quality and rapidly attenuation (or damping) of sound components of higher frequencies. Therefore, it is possible to produce sharp and articulated sounds having balanced pitches (or intervals) which are similar to those of natural-leather heads.

(2) It is possible to form irregularities having substantially uniform sizes and dimensions by chemical etching in comparison with mechanical polishing. Hence, it is possible to actualize adequate balances in sound with respect to attack, sustain, and decay portions. Thus, it is possible to manufacture percussion instrument heads having stable qualities without causing variations in sound qualities. In addition, the percussion instrument head can simulate the exterior appearance of the natural-leather head by adequately performing chemical etching on the designated surface thereof.

(3) When a PET film is used as the synthetic resin film for use in manufacture of the percussion instrument head, a caustic alkali solution is used to process the surface(s) of the film, wherein hydrolysis processing advances firstly on the fibered surface(s) of the film, which is adequately dissolved to be made rough. In hydrolysis processing, dissolution (or decomposition) occurs uniformly on the entire surface(s) of the film; therefore, it is possible to form the rough surface(s) of the film on which irregularities are formed in substantially uniform sizes and dimensions. Due to the formation of the rough surface(s), it is possible to increase the flexibility of the film in comparison with the film having flat (or planar) surfaces. Therefore, it is possible to produce sharp and articulated sounds having balanced pitches (or intervals) because of adequate cutoff of overtones.

As this invention may be embodied in several forms without departing from the spirit or essential characteristics thereof, the present embodiments are therefore illustrative and not restrictive, since the scope of the invention is defined by the appended claims rather than by the description preceding them, and all changes that fall within metes and bounds of the claims, or equivalents of such metes and bounds are therefore intended to be embraced by the claims.

What is claimed is:

1. A percussion instrument head that is stretched in tension across an opening of a cylinder body of a percussion instrument, the percussion instrument head comprising:

a synthetic resin film having a prescribed thickness, at least one surface of which is subjected to chemical etching to form irregularities having substantially uniform sizes and dimensions on the at least one surface of the synthetic resin film.

2. A percussion instrument head according to claim 1, wherein the synthetic resin film is a polyethylene terephthalate film, which is subjected to chemical etching using a caustic alkali solution.

3. A percussion instrument head according to claim 1, wherein the prescribed thickness ranges from 50 μm to 350 μm.

4. A percussion instrument head according to claim 1, wherein the irregularities are controlled in depth and substantially range from 1.5 μm to 3 μm.

5. A percussion instrument head according to claim 1, wherein after completion of the chemical etching, the synthetic resin film is coated with an epoxy resin.

6. A percussion instrument head according to claim 1, wherein two surfaces of the synthetic resin film are subjected to chemical etching to form irregularities which are substantially uniform in size and dimension on the two surfaces of the synthetic resin film.

7. A percussion instrument head according to claim 1, wherein the at least one surface is one of a front surface and a back surface of the synthetic resin film.

8. A percussion instrument comprising:

a body having an opening; and a head stretched across the opening of the body, the head comprising:

a synthetic resin film having a prescribed thickness, at least one surface of which is subjected to chemical etching to form irregularities having substantially uniform sizes and dimensions on the at least one surface of the synthetic resin film.

9. A percussion instrument head according to claim 8, wherein the synthetic resin film is a polyethylene terephthalate film, which is subjected to chemical etching using a caustic alkali solution.

10. A percussion instrument head according to claim 8, wherein the prescribed thickness ranges from 50 $\mu$m to 350 $\mu$m.

11. A percussion instrument head according to claim 8, wherein the irregularities are controlled in depth and substantially range from 1.5 $\mu$m to 3 $\mu$m.

12. A percussion instrument head according to claim 8, wherein after completion of the chemical etching, the synthetic resin film is coated with an epoxy resin.

13. A percussion instrument head according to claim 8, wherein two surfaces of the synthetic resin film are subjected to chemical etching to form irregularities which are substantially uniform in size and dimension on the two surfaces of the synthetic resin film.

14. A percussion instrument head according to claim 8, wherein the at least one surface is one of a front surface and a back surface of the synthetic resin film.

* * * * *